US008182297B2

(12) United States Patent
Lin

(10) Patent No.: US 8,182,297 B2
(45) Date of Patent: May 22, 2012

(54) LATCHED CONNECTOR ASSEMBLY

(75) Inventor: Chih-Hsin Lin, Xianxi Township, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 16 days.

(21) Appl. No.: 12/827,384

(22) Filed: Jun. 30, 2010

(65) Prior Publication Data

US 2011/0287655 A1 Nov. 24, 2011

(30) Foreign Application Priority Data

May 24, 2010 (TW) ..... 99209739 U

(51) Int. Cl.
*H01R 13/502* (2006.01)

(52) U.S. Cl. ..... 439/701; 439/357; 439/903

(58) Field of Classification Search ..... 439/357, 439/701, 596, 903
See application file for complete search history.

(56) References Cited

U.S. PATENT DOCUMENTS

| | | | | |
|---|---|---|---|---|
| 4,431,244 | A * | 2/1984 | Anhalt et al. | 439/358 |
| 5,238,427 | A * | 8/1993 | Fry et al. | 439/557 |
| 5,342,221 | A * | 8/1994 | Peterson | 439/677 |
| 5,393,235 | A * | 2/1995 | Ingalsbe | 439/76.1 |
| 5,605,472 | A * | 2/1997 | Sakai et al. | 439/489 |
| 6,132,233 | A * | 10/2000 | Fukuda | 439/357 |
| 6,183,287 | B1 * | 2/2001 | Po | 439/358 |
| 6,364,718 | B1 * | 4/2002 | Polgar et al. | 439/680 |
| 6,860,765 | B1 * | 3/2005 | Spink, Jr. | 439/680 |
| 7,195,518 | B2 * | 3/2007 | Bert et al. | 439/607.43 |
| D581,366 | S * | 11/2008 | Knepper | D13/154 |
| 7,470,143 | B2 * | 12/2008 | Osborn et al. | 439/441 |
| 7,618,279 | B1 * | 11/2009 | Osborn et al. | 439/441 |
| 7,867,008 | B1 * | 1/2011 | Lin | 439/350 |
| 7,874,865 | B2 * | 1/2011 | Tobey | 439/460 |
| 7,892,007 | B2 * | 2/2011 | Scherer et al. | 439/329 |
| 7,972,164 | B2 * | 7/2011 | Bucher | 439/354 |
| 7,976,330 | B2 * | 7/2011 | Lin | 439/353 |
| 7,988,481 | B2 * | 8/2011 | Bethurum et al. | 439/353 |
| 2003/0017747 | A1 * | 1/2003 | Blanchfield et al. | 439/677 |
| 2004/0077207 | A1 * | 4/2004 | Ice | 439/357 |
| 2005/0064757 | A1 * | 3/2005 | Kathan et al. | 439/357 |
| 2006/0217003 | A1 * | 9/2006 | Martin et al. | 439/701 |
| 2007/0270017 | A1 * | 11/2007 | Hardacker et al. | 439/357 |
| 2008/0248680 | A1 * | 10/2008 | Stoner et al. | 439/357 |
| 2011/0053406 | A1 * | 3/2011 | Lin | 439/358 |

* cited by examiner

*Primary Examiner* — Amy Cohen Johnson
*Assistant Examiner* — Vladimir Imas
(74) *Attorney, Agent, or Firm* — Ming Chow; Sinorica, LLC

(57) ABSTRACT

A latched connector assembly includes a first connecting device and a second connecting device latched to each other. The first connecting device has a first casing and two terminal connectors received in the first casing. The first casing has first and second side walls. The first side walls have first engaging structures protruding outward. The second side walls each have an extending arm that has a second engaging structure. The second connecting device has a second casing and at least two terminal connectors received in the second casing. The second casing has third and fourth side walls. The third side walls have first engaging structures protruding outward. The fourth side walls each have a locking portion protruding outward for receiving the second engaging structures of the first connecting device. The terminal connectors are received, in opposite directions, in the first casing and the second casing, respectively.

2 Claims, 14 Drawing Sheets

20

3

30

LATCHED CONNECTOR ASSEMBLY

BACKGROUND OF THE INVENTION

1. Technical Field

The present invention relates to connector assemblies, and more particularly, to a connector assembly having a latched device.

2. Description of Related Art

Connectors are widely applied to various industries and a wide variety of electrical equipment. Users transmit required data, signals, and electricity quickly through the use of connectors. The advent of connectors speeds up information reception and promotes convenience of daily life.

Referring to FIG. 1, regarding a first connecting device 91, a second connecting device 92, and a terminal connector 93 disclosed according to the prior art, with a pin 94, the terminal connector 93 is fixed to the prior-art first connecting device 91 or to the prior-art second connecting device 92. However, the process of fixing the terminal connector 93 to the prior-art first connecting device 91 or to the prior-art second connecting device 92 by the pin 94 entails the step of inserting the pin 94. The aforesaid process has two other drawbacks: the process requires the pin 94 which is made of metal and thus incurs high costs; and the step of inserting the pin 94 and securing the pin 94 in position prevents enhancement of productivity.

BRIEF SUMMARY OF THE INVENTION

In order to solve the above and other problems, the present invention provides a latched connector assembly comprising a first connecting device and a second connecting device latched to each other. The first connecting device has a first casing and at least two terminal connectors received in the first casing. The first casing has a first opening, a second opening, and a first receiving space in communication with the first and second openings, a pair of first side walls, and a pair of second side walls perpendicular to the first side walls. The first side walls each have a window and at least one first engaging structure protruding outward. The second side walls each have an extending arm extending toward the second connecting device. The front end of the extending arm has a second engaging structure. The first engaging structures penetrate the windows, respectively, to hold firmly the terminal connectors in the first casing. The second connecting device has a second casing and at least two terminal connectors received in the second casing. The second casing has a third opening, a fourth opening, a second receiving space in communication with the third and fourth openings, a pair of third side walls, and a pair of fourth side walls perpendicular to the third side walls. The third opening faces the first opening of the first connecting device. The third side walls each have a window and at least one first engaging structure protruding outward. The fourth side walls each have a locking portion protruding outward to receive the second engaging structures of the first connecting device. The first engaging structures penetrate the windows, respectively, to hold firmly the terminal connectors in the second casing. The direction in which two said terminal connectors are received in the first casing is upside down opposite to the direction in which two said terminal connectors are received in the second casing.

Hence, it is a primary objective of the present invention to provide such a latched connector assembly. The first and second connecting devices of the latched connector assembly have the first engaging structures for securing the terminal connectors in position to thereby dispense with a pin which might otherwise be required to fasten the terminal connectors in position. Hence, the latched connector assembly of the present invention is effective in cutting costs.

Another objective of the present invention is to provide such a latched connector assembly. The first and second connecting devices of the latched connector assembly have the first engaging structures for securing the terminal connectors in position to thereby dispense with the step of inserting a pin. Hence, the latched connector assembly of the present invention is effective in speeding up the fabrication process and enhancing productivity.

DETAILED DESCRIPTION OF THE INVENTION

The present invention essentially discloses a latched connector assembly. Fundamental principles of latched connection embodied in the present invention are comprehensible by persons skilled in the art and thus are not described in detail hereunder. Also, the drawings corresponding to the description below are schematic, structural illustrations of the features of the present invention, and are not and have not to be drawn to scale.

Figure 1:
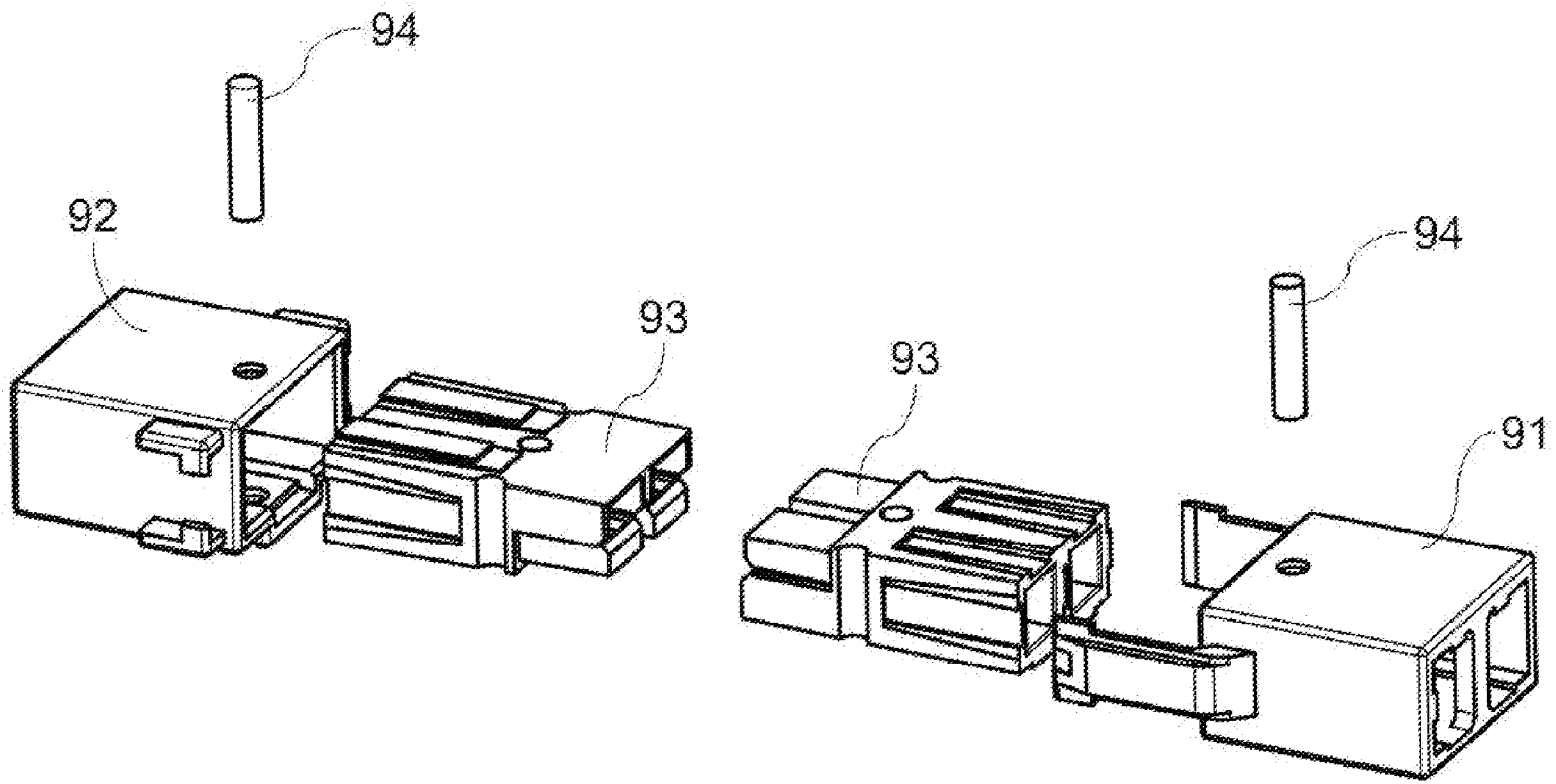
FIG. 1 (Prior Art)
FIG. 1 is a schematic view of a connector assembly according to the prior art.
Figure 2:
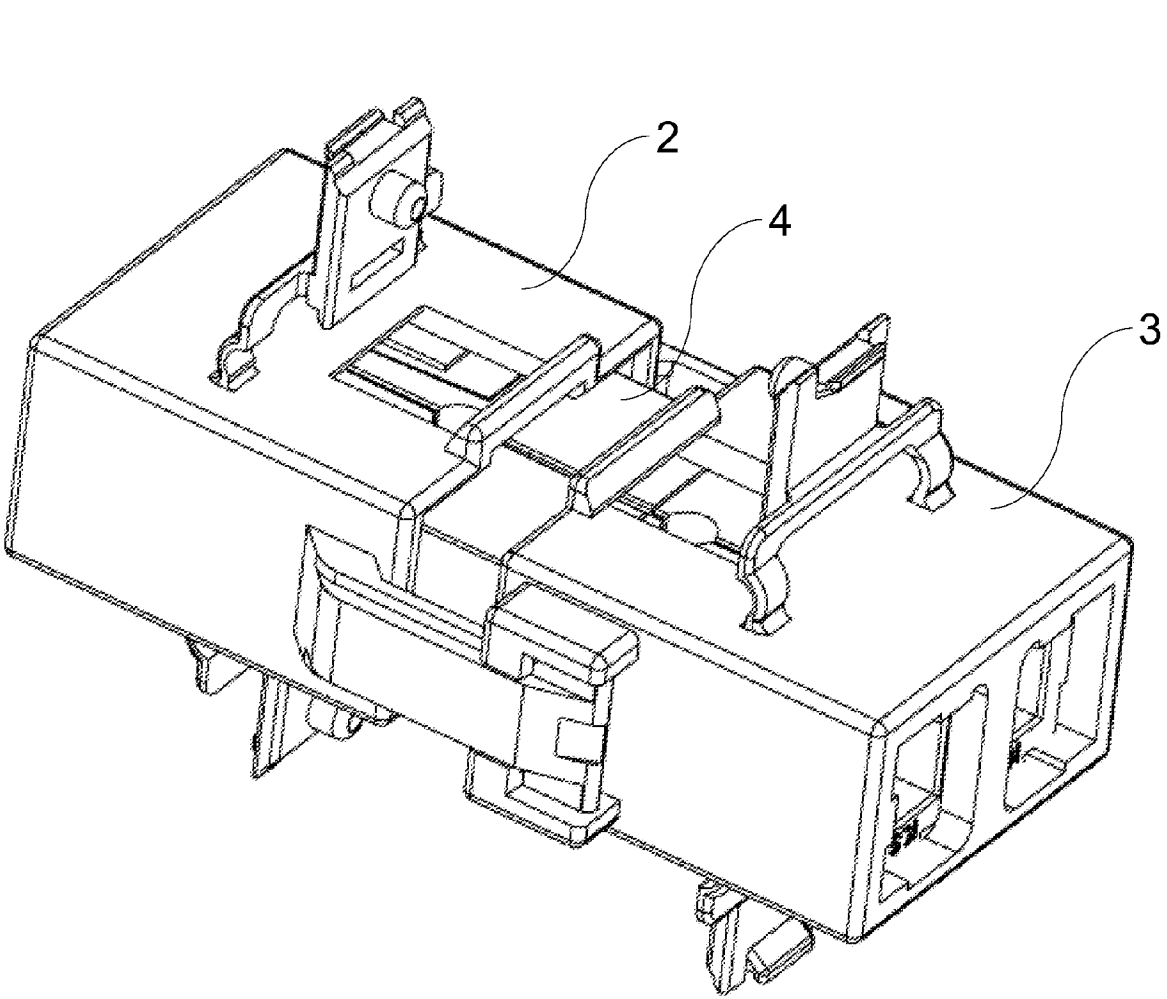
FIG. 2 is a schematic view of a latched connector assembly according to the present invention.
Figure 3A:
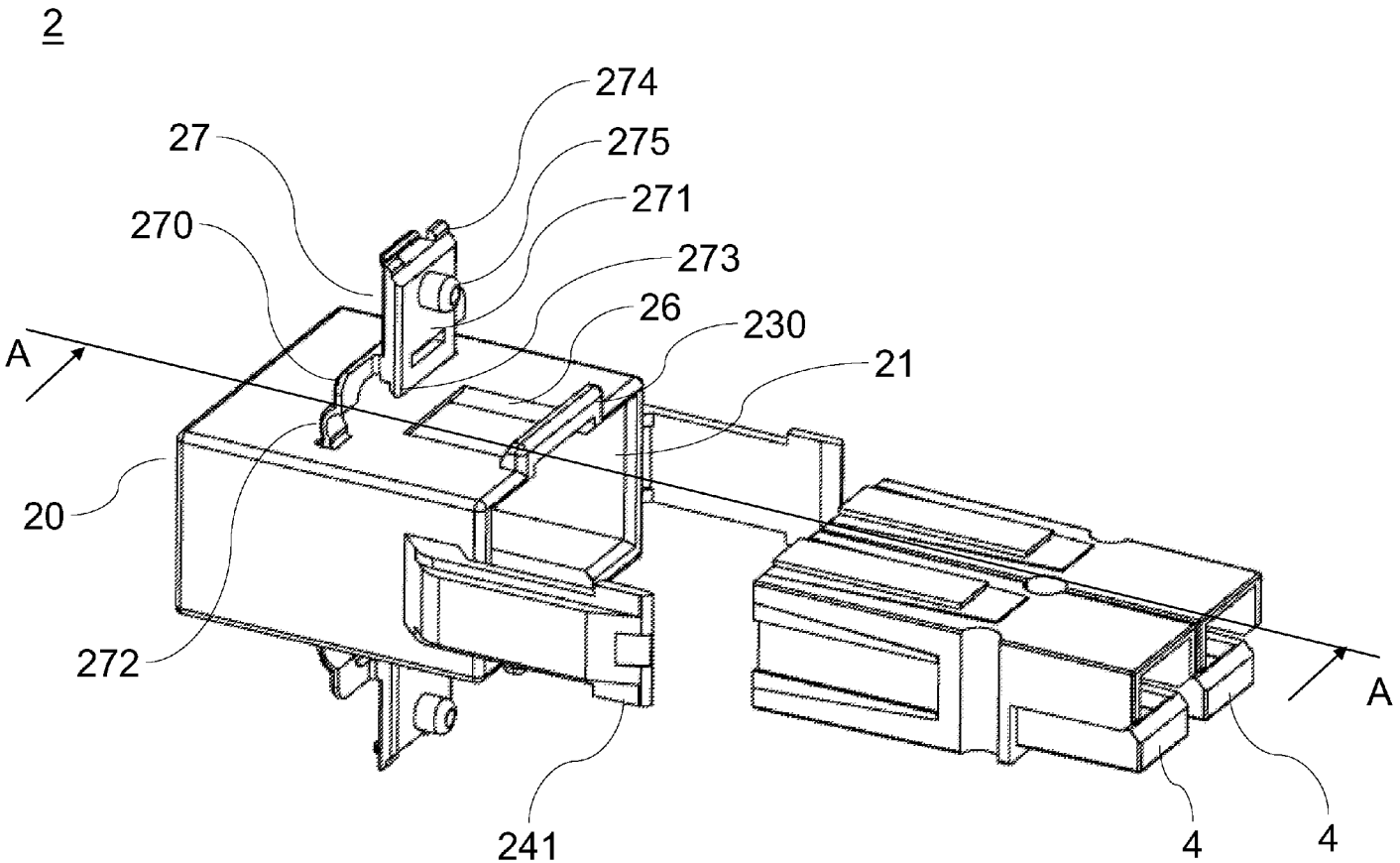
FIG. 3A is a schematic exploded view of a first connecting device according to the present invention.
Figure 3B:
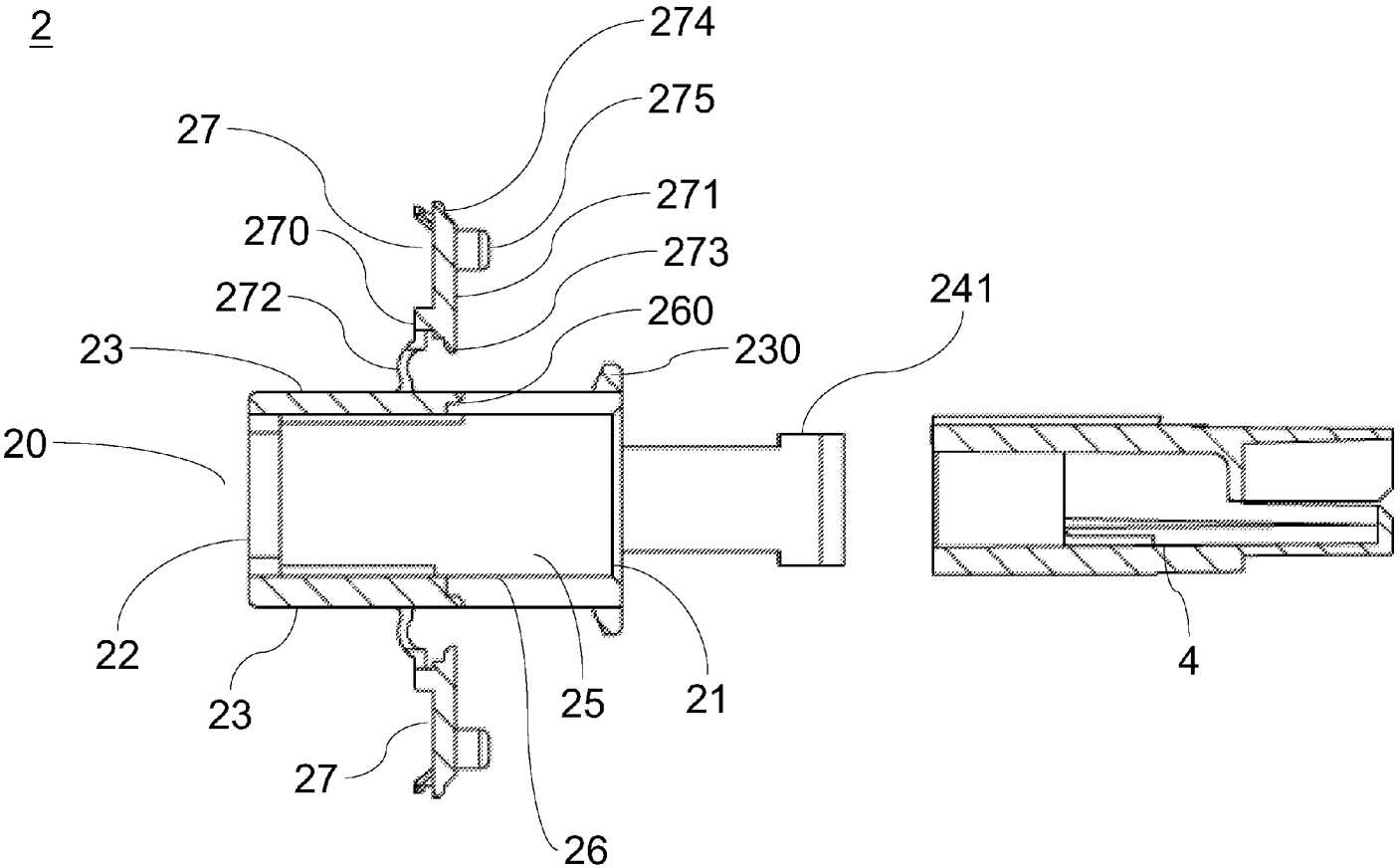
FIG. 3B is a cross-sectional view of the first connecting device according to the present invention.
Figure 3C:
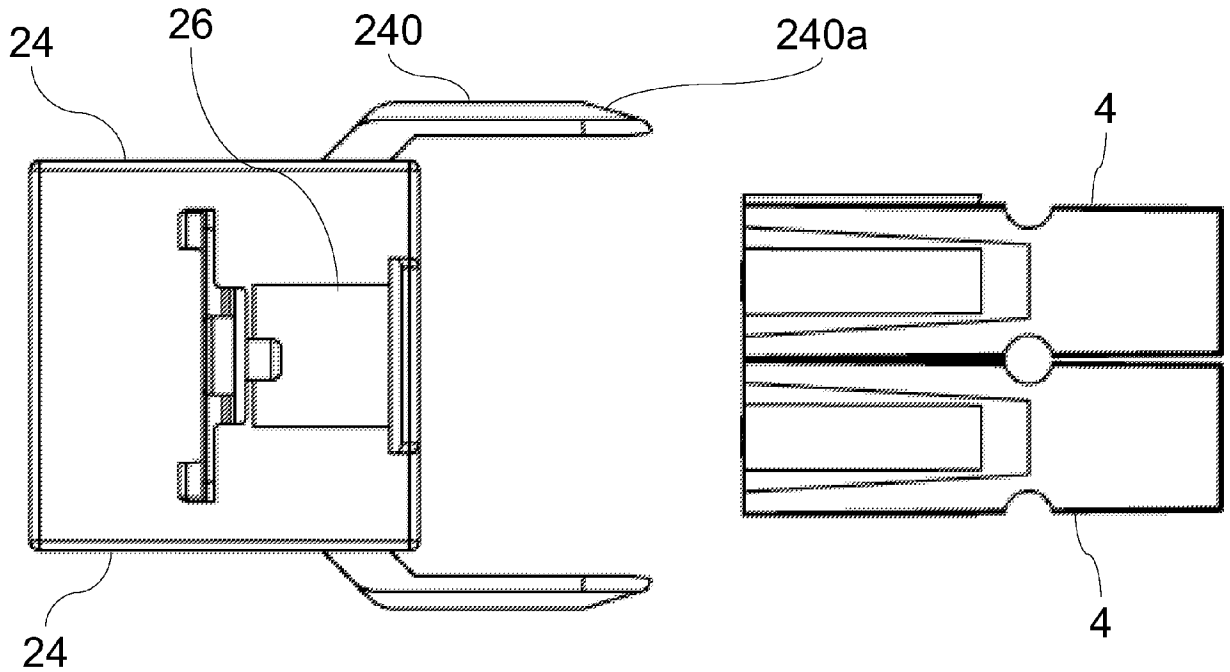
FIG. 3C is a top view of the first connecting device according to the present invention.
Figure 3D:
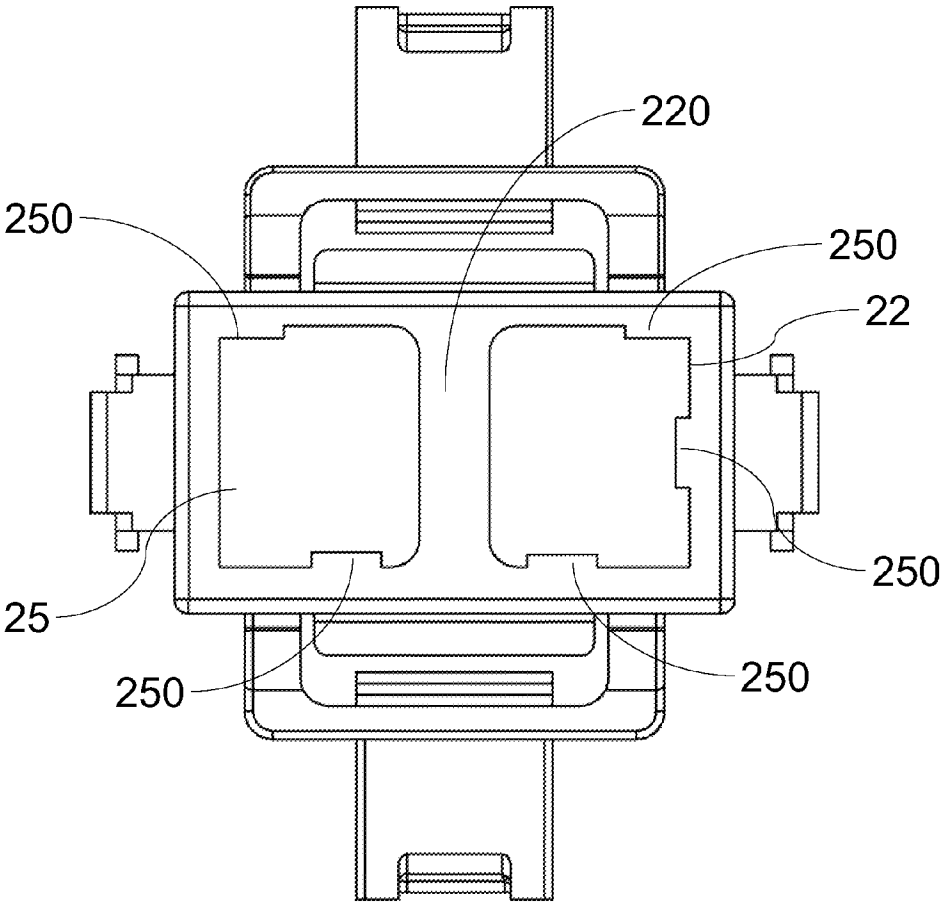
FIG. 3D is a left side view of a first casing of FIG. 3C.

Referring to FIG. 2, a latched connector assembly 1 of the present invention essentially comprises a first connecting device 2, a second connecting device 3, and terminal connectors 4 latched to the first and second connecting devices 2, 3. Referring to FIG. 3A, the first connecting device 2 comprises a first casing 20 and at least two said terminal connectors 4 received in the first casing 20. Referring to FIG. 3B and FIG. 3C, FIG. 3B is a cross-sectional view taken along line A-A of FIG. 3A, and FIG. 3C is a top view of the first connecting device 2 of FIG. 3A. The first casing 20 has a first opening 21, a second opening 22, and a first receiving space 25 in communication with the first and second openings 21, 22. The first casing 20 further has a pair of first side walls 23, and a pair of second side walls 24 perpendicular to the first side walls 23. The second side walls 24 each have an extending arm 240 protruding outward. The front end of each of the extending arms 240 has a slope 240*a* whereby the extending arms 240 taper. The front end of each of the extending arms 240 further has a second engaging structure 241. The first side walls 23 each have a window 26 and at least one first engaging structure 27 protruding outward. The first engaging structure 27 has an extending portion 270 and an engaging portion 271. A bending portion 272 is formed to connect each of the extending portions 270 and a corresponding one of the first side walls 23. The engaging portion 271 has an end provided with a first shoulder portion 273 positioned proximate to the extending portion 270. The engaging portion 271 has the other end positioned distal to the first shoulder portion 273 and provided with a fastening portion 274. The engaging portion 271 has an engaging tenon 275 configured to face the first receiving space 25. The window 26 has a second shoulder portion 260 corresponding in position to the first shoulder portion 273. The first shoulder portion 273 and the second shoulder portion 260 are configured to abut against each other. The engaging tenons 275 of the first engaging structures 27 penetrate the windows 26, respectively, to hold firmly the terminal connectors 4 in the first casing 20. The first side walls 23 each have a protruding portion 230 protruding outward. The fastening portions 274 are configured to abut against the protruding portions 230, respectively. Referring to FIG. 3D, the first receiving space 25 is provided therein with foolproof mechanism 250, and the second opening 22 is further provided with a support rib 220.

Figure 4A:
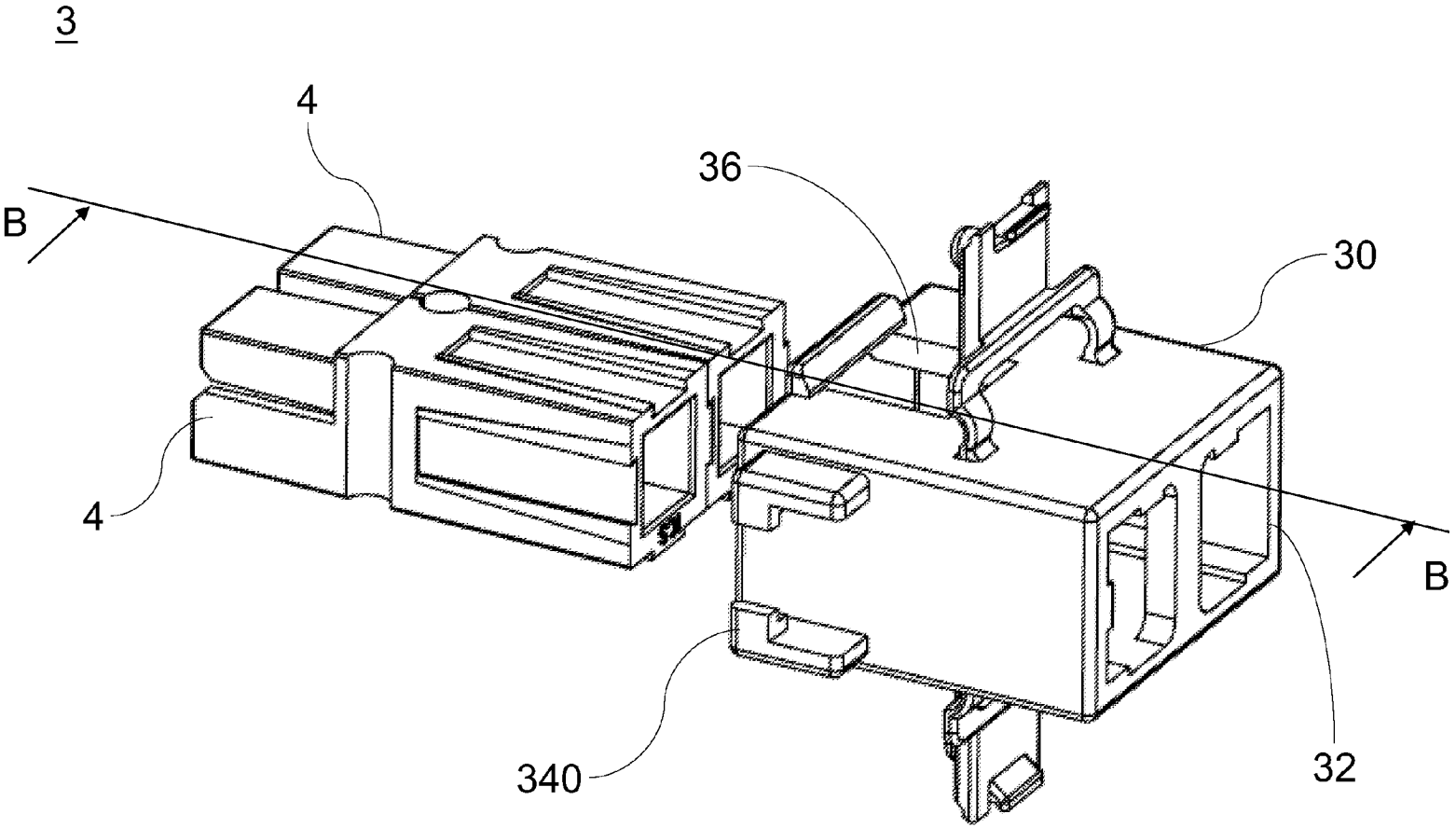
FIG. 4A is a schematic exploded view of a second connecting device according to the present invention.
Figure 4B:
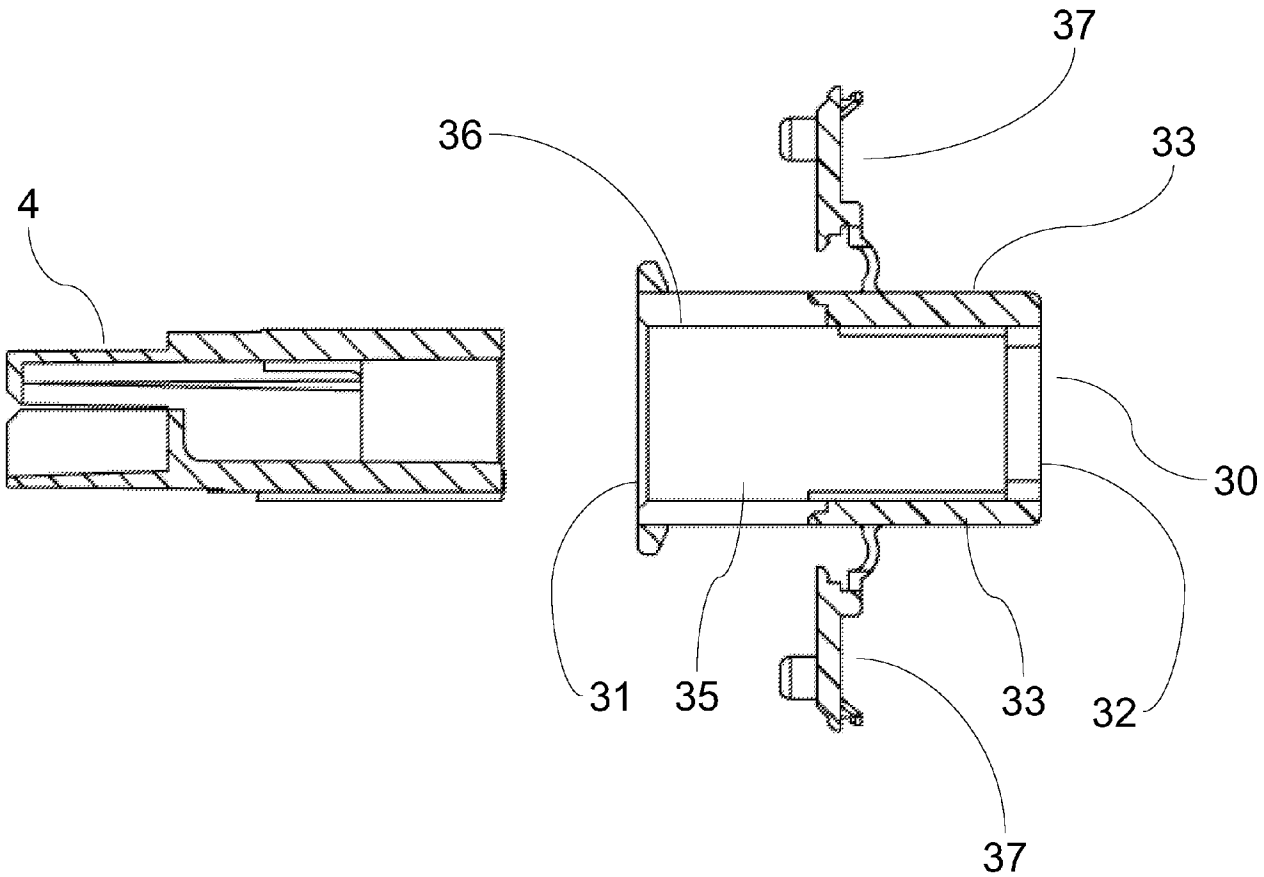
FIG. 4B is a cross-sectional view of the second connecting device according to the present invention.
Figure 4C:
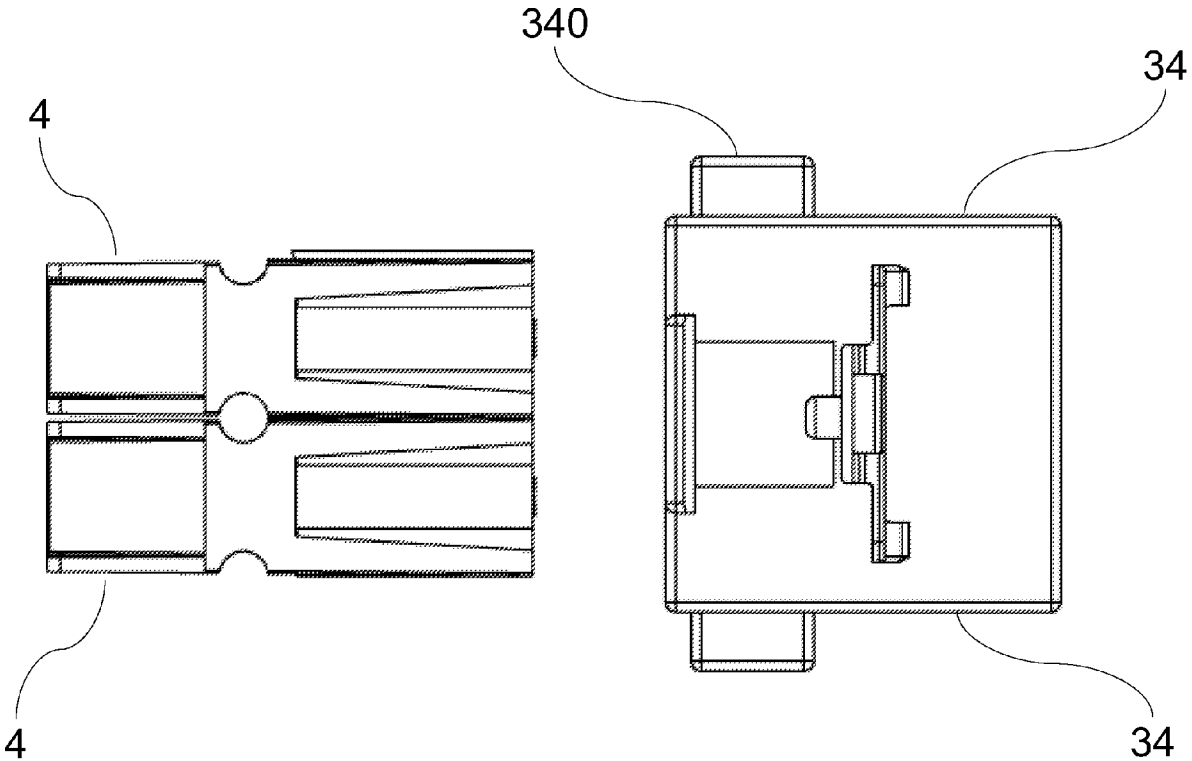
FIG. 4C is a top view of the second connecting device according to the present invention.
Figure 4D:
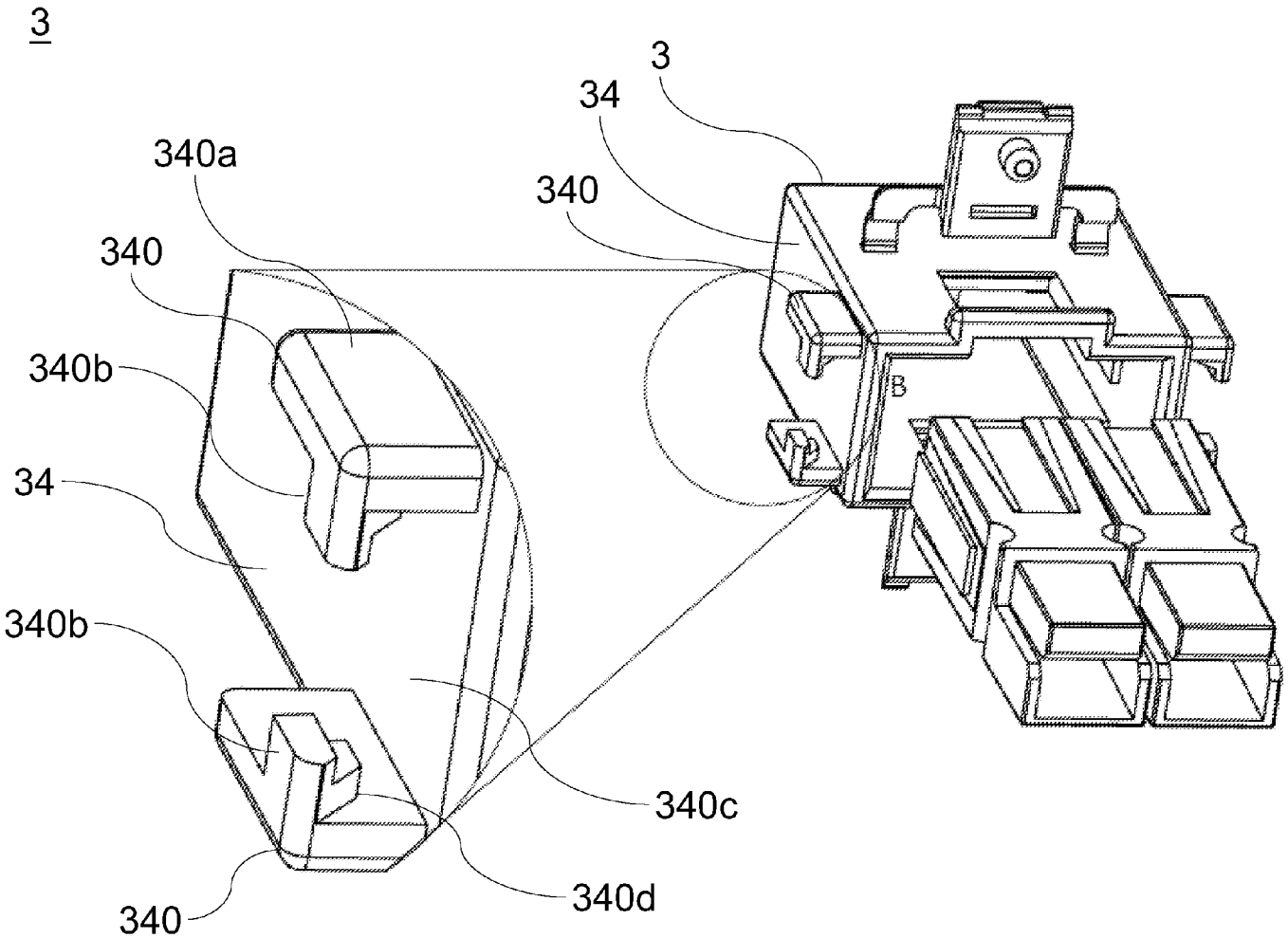
FIG. 4D is a schematic enlarged view of a locking portion of the second connecting device according to the present invention.
Figure 4E:
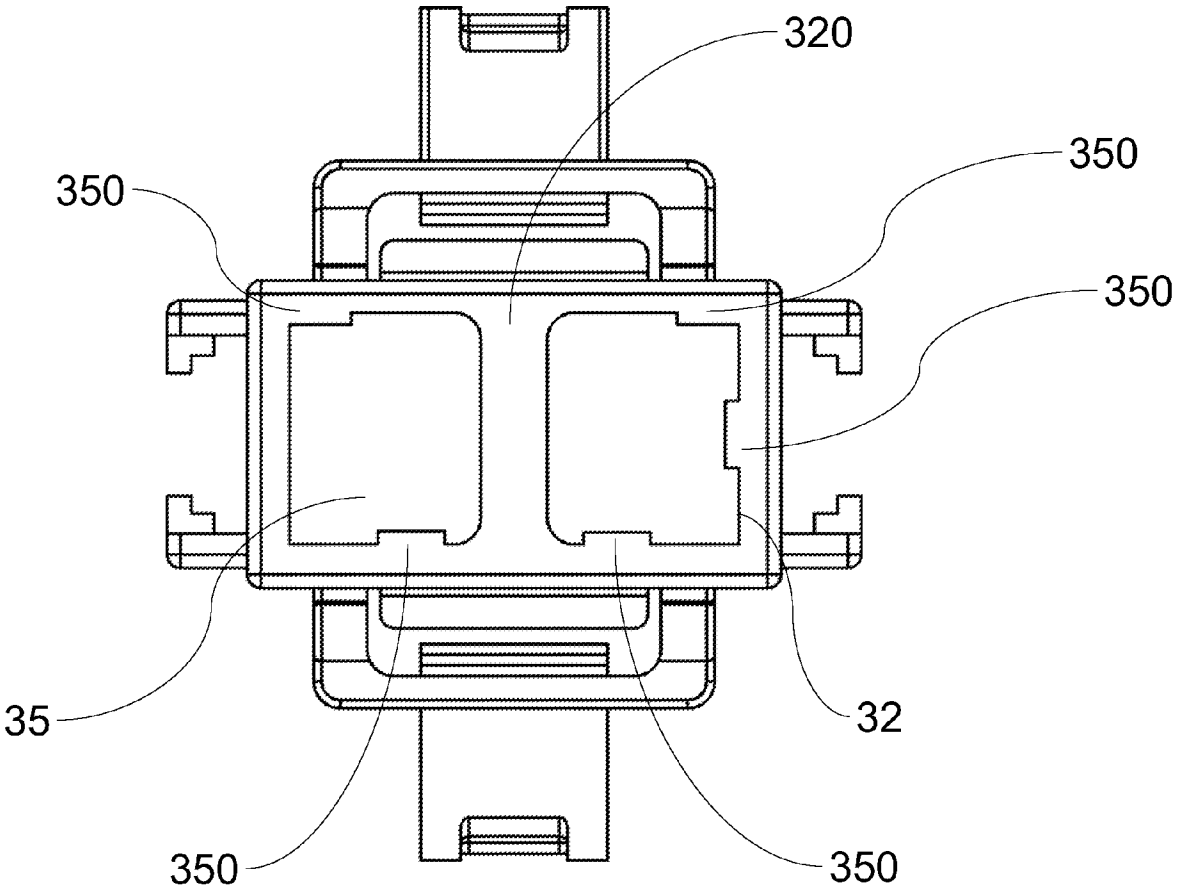
FIG. 4E is a right side view of a second casing of FIG. 4C.

Referring to FIG. 4A, the second connecting device 3 of the present invention has a second casing 30 and at least two said terminal connectors 4 received in the second casing 30. Referring to FIG. 4B and FIG. 4C, FIG. 4B is a cross-sectional view taken along line B-B of FIG. 4A, and FIG. 4C is a top view of the second connecting device 3 of FIG. 4A. The second casing 30 has a third opening 31, a fourth opening 32, a second receiving space 35 in communication with the third opening 31 and the fourth opening 32, a pair of third side walls 33, and a pair of fourth side walls 34 perpendicular to the third side walls 33. The third side walls 33 each have a window 36 and a first engaging structure 37 protruding outward. The first engaging structures 37 of the second connecting device 3 penetrate the windows 36, respectively, to hold firmly the terminal connectors 4 in the second casing 30. The terminal connectors 4 are firmly held by the first engaging structure 37 of the second connecting device 3 in the same way as by the first engaging structure 27 of the first connecting device 2; hence, a related description thereof is omitted herein for the sake of brevity. The fourth side walls 34 each have a locking portion 340 protruding outward. Referring to FIG. 4D, the locking portions 340 have side panels 340*a*, respectively, and the side panels 340*a* have top ends extending toward each other to form flanges 340*b*, respectively. Two opposing said flanges 340*b* together form a coupling opening 340*c* therebetween. A wedge-shaped plane 340*d* is formed between each of the flanges 340*b* and a corresponding one of the fourth side walls 34 of the second casing 30. Referring to FIG. 4E, the second receiving space 35 is provided therein with foolproof mechanism 350. The fourth opening 32 is further provided with a support rib 320.

Figure 5A:
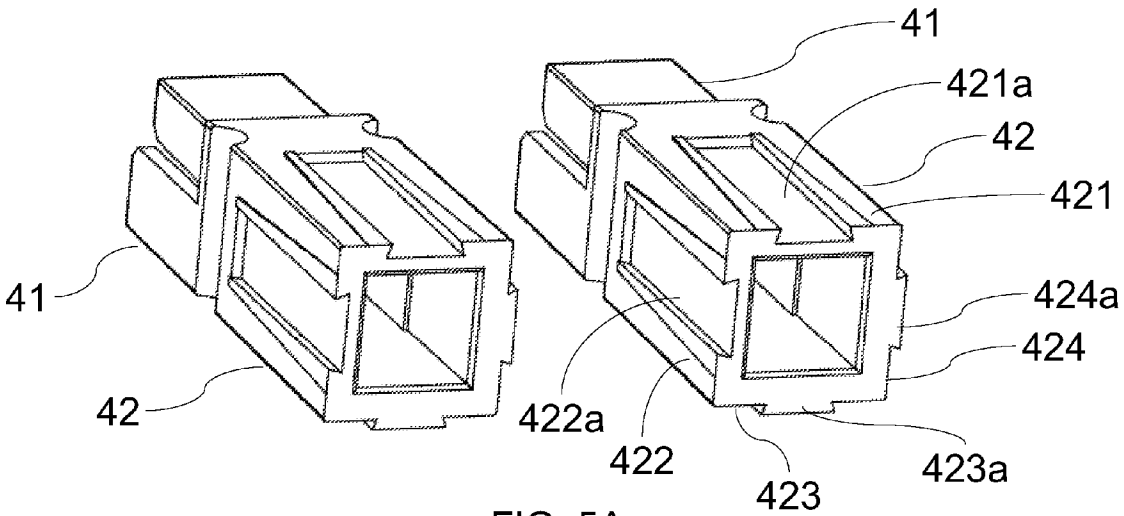
FIG. 5A is a schematic view of terminal connectors according to the present invention.
Figure 5B:
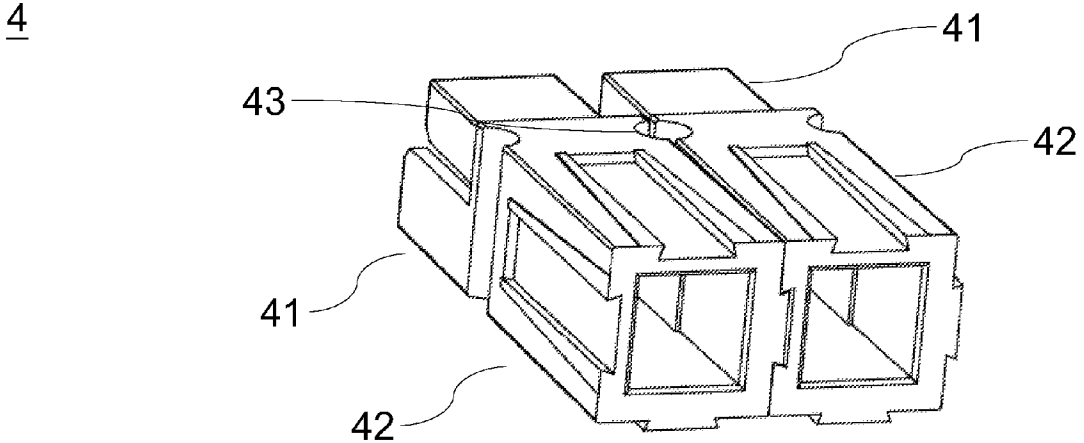
FIG. 5B is a schematic view of the assembled terminal connectors according to the present invention.

Referring to FIG. 5A, the terminal connectors 4 each have a connecting portion 41 and an embedding portion 42. The embedding portion 42 has a first connecting wall 421, a second connecting wall 422, a third connecting wall 423, and a fourth connecting wall 424, which are arranged in a manner like the four sides of a rectangle. The first connecting wall 421 and the second connecting wall 422 have embedding channels 421*a*, 422*a*, respectively. The embedding channels 421*a*, 422*a* are shaped like a dovetail groove. The third connecting wall 423 and the fourth connecting wall 424 have embedding tenons 423*a*, 424*a*. The embedding tenons 423*a*, 424*a* are shaped like a dovetail saddle. The embedding channel 422*a* of the second connecting wall 422 of one said terminal connector 4 and the embedding tenon 424*a* of the fourth connecting wall 424 of another said terminal connector 4 can be engaged with each other. Referring to FIG. 5B, after two said terminal connectors 4 have been engaged with each other, an engaging hole 43 is formed between two said terminal connectors 4 at a position between the connecting portion 41 and the embedding portion 42. The engaging hole 43 corresponds in position to the engaging tenon 275 of the first engaging structure, thereby allowing the engaging hole 43 and the engaging tenon 275 to be engaged with each other.

Figure 6A:
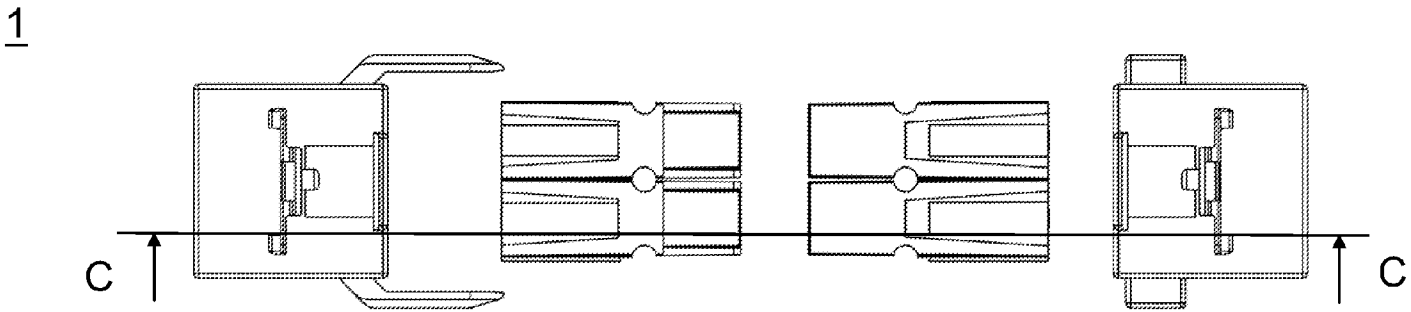
FIG. 6A is a top view of the latched connector assembly according to the present invention.
Figure 6B:
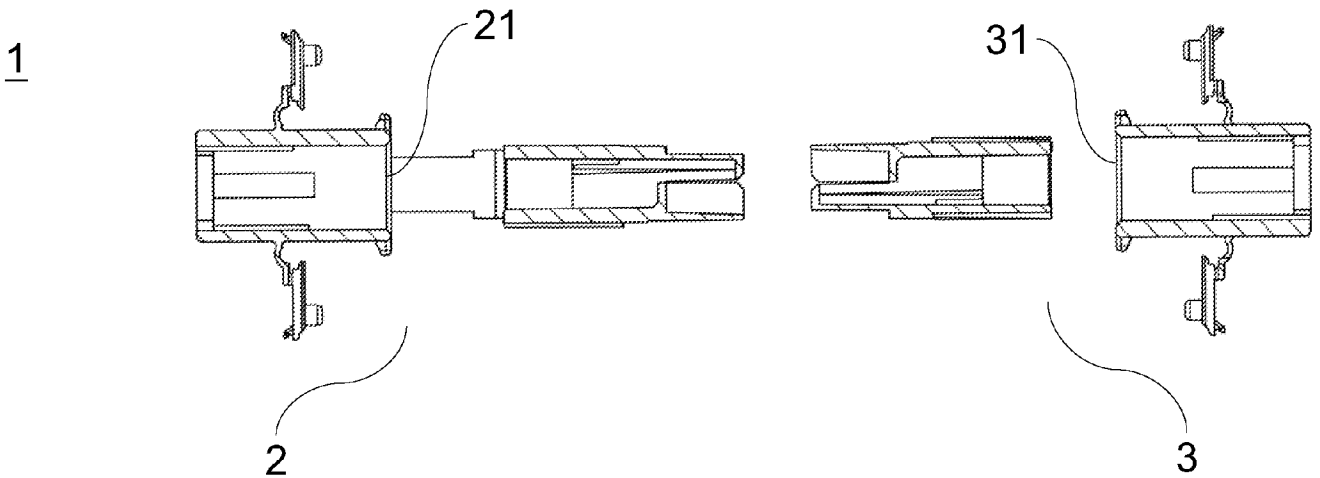
FIG. 6B is a cross-sectional view of the latched connector assembly according to the present invention.
Figure 6C:
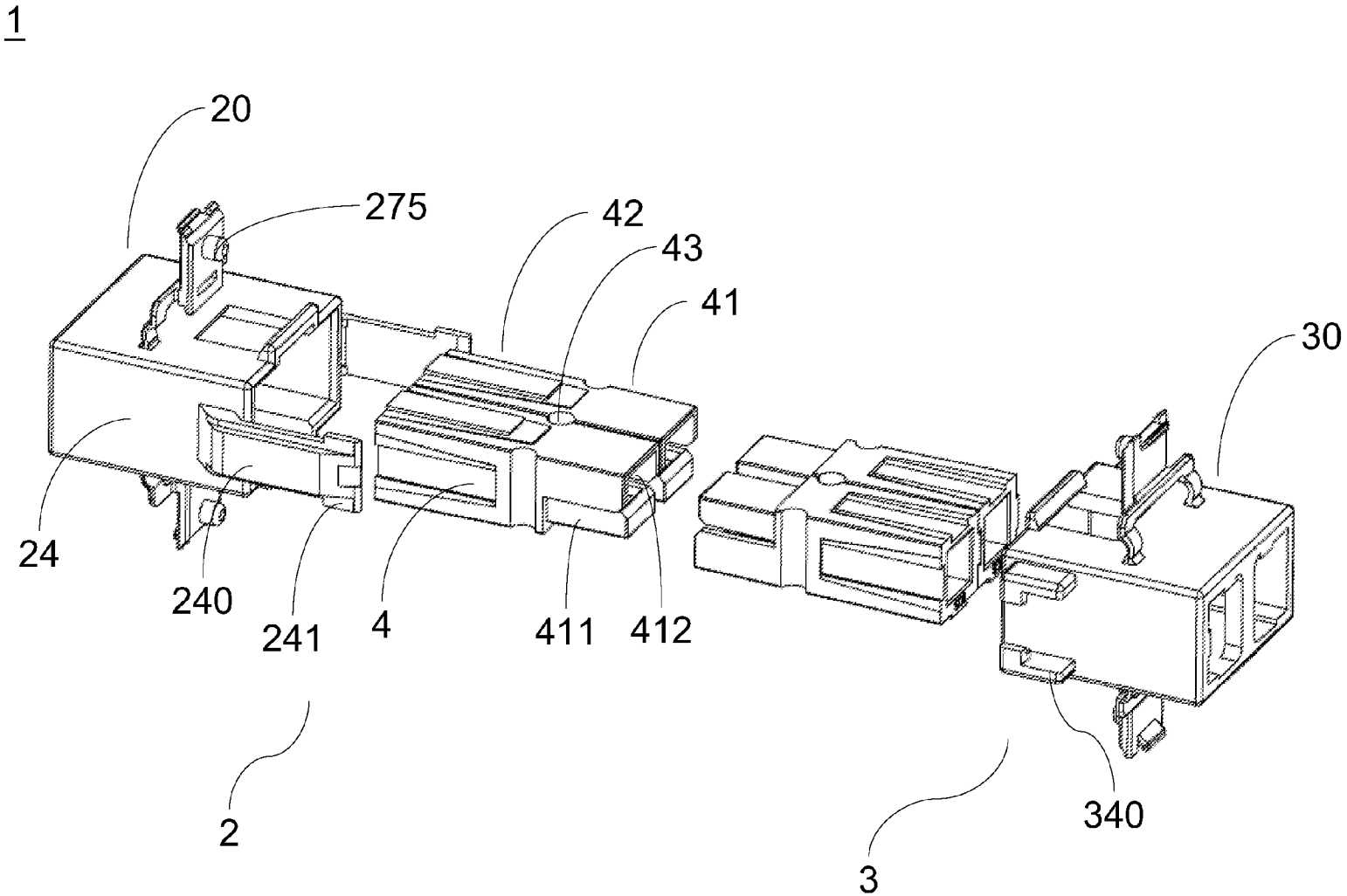
FIG. 6C is a schematic view of the latched connector assembly according to the present invention.

Referring to FIG. 6A and FIG. 6B, the latched connector assembly 1 of the present invention is shown, wherein FIG. 6B is a cross-sectional view taken along line C-C of FIG. 6A. The first opening 21 of the first connecting device 2 corresponds in position to the third opening 31 of the second connecting device 3. Referring to FIG. 6C, the second side walls 24 of the first connecting device 2 have the extending arms 240, respectively, protruding towards the second connecting device 3, and the extending arms 240 each have a front end provided with the second engaging structure 241. The second engaging structures 241 are each a flat protrusion. The coupling openings 340*c* (see FIG. 4D) of the second connecting device 3 are configured to receive the second engaging structures 241 of the first connecting device 2. Also, the wedge-shaped plane 340*d* of the a locking portion 340 of the second connecting device 3 (see FIG. 4D) further prevents the second engaging structure 241 at the front end of the extending arm 240 of the first connecting device 2 from sliding reversely to be disconnected; as a result, it is feasible to hold the second engaging structure 241 of the first connecting device 2 and the a locking portion 340 of the second connecting device 3 together firmly. Furthermore, the terminal connectors 4 each have the connecting portion 41 and the embedding portion 42. The connecting portion 41 has a connecting tenon 411 and a connecting hole 412. The direction in which at least two said terminal connectors 4 are received in the first casing 20 is upside down opposite to the direction in which at least two said terminal connectors 4 are received in the second casing 30; hence, to put the first connecting device 2 and the second connecting device 3 together, it is feasible to have the terminal connectors 4 of the first connecting device 2 and the terminal connectors 4 of the second connecting device 3 engaged to each other by the connecting tenon 411 and the connecting hole 412 of the terminal connectors 4. The above description pertains to a preferred embodiment of the present invention, but is not intended to be restrictive of the scope of the claims of the present invention. Also, the above description is comprehensible and accomplishable by persons skilled in the art. Hence, all equivalent modifications and variations made to the foregoing embodiment without departing from the spirit in the disclosure of the present invention should fall within the scope of the invention as set forth in the appended claims.

What is claimed is:

1. A latched connector assembly comprising a first connecting device and a second connecting device, characterized in:

the first connecting device having a first casing and at least two terminal connectors received in the first casing, the first casing having a first opening, a second opening, a first receiving space in communication with the first opening and the second opening, a pair of first side walls, and a pair of second side walls perpendicular to the first side walls;

the first side walls each having a window and at least a first engaging structure protruding outward, the first engaging structure having an extending portion and an engaging portion, the extending portion being connected to the corresponding first side wall via a bending portion disposed therebetween, the engaging portion having an end located proximate to the extending portion and provided with a first shoulder portion, the window having a second shoulder portion corresponding in position to the first shoulder portion so as to allow the first shoulder portion and the second shoulder portion to abut against each other;

the second side walls each having an extending arm extending toward the second connecting device, the extending arms each having a front end with a second engaging structure, the first engaging structures penetrating the windows, respectively, to hold firmly the terminal connectors in the first casing;

the second connecting device having a second casing and at least two terminal connectors received in the second casing, the second casing having a third opening, a fourth opening, a second receiving space in communication with the third opening and the fourth opening, a pair of third side walls, and a pair of fourth side walls perpendicular to the third side walls; and the third opening facing the first opening of the first connecting device, the third side walls each having a window and at least a first engaging structure protruding outward, the fourth side walls each having at least a locking portion protruding outward for receiving the second engaging structures of the first connecting device, the first engaging structures penetrating the windows, respectively, to hold firmly the terminal connectors in the second casing;

wherein the terminal connectors are received, in upside down opposite directions, in the first casing and the second casing, respectively.

2. A latched connector assembly comprising a first connecting device and a second connecting device, characterized in:

the first connecting device having a first casing and at least two terminal connectors received in the first casing, the first casing having a first opening, a second opening, a first receiving space in communication with the first opening and the second opening, a pair of first side walls, and a pair of second side walls perpendicular to the first side walls;

the first side walls each having a window and at least a first engaging structure protruding outward, the first engaging structure having an extending portion and an engaging portion, the extending portion being connected to the corresponding first side wall via a bending portion disposed therebetween, the engaging portion having a first end located proximate to the extending portion and provided with a first shoulder portion and a second end located distal to the first shoulder portion and provided with a fastening portion, the window having a second shoulder portion corresponding in position to the first shoulder portion so as to allow the first shoulder portion and the second shoulder portion to abut against each other;

the second side walls each having an extending arm extending toward the second connecting device, the extending arms each having a front end with a second engaging structure, the first engaging structures penetrating the windows, respectively, to hold firmly the terminal connectors in the first casing;

the second connecting device having a second casing and at least two terminal connectors received in the second casing, the second casing having a third opening, a fourth opening, a second receiving space in communication with the third opening and the fourth opening, a pair of third side walls, and a pair of fourth side walls perpendicular to the third side walls; and the third opening facing the first opening of the first connecting device, the third side walls each having a window and at least a first engaging structure protruding outward, the fourth side walls each having at least a locking portion protruding outward for receiving the second engaging structures of the first connecting device, the first engaging structures penetrating the windows, respectively, to hold firmly the terminal connectors in the second casing;

wherein the first side walls and the third side walls each have a protruding portion extending outward so as to allow the fastening portion to abut against the protruding portion, and the terminal connectors are received, in upside down opposite directions, in the first casing and the second casing, respectively.

* * * * *